United States Patent [19]

Lipukhin et al.

[11] Patent Number: 4,947,587

[45] Date of Patent: Aug. 14, 1990

[54] CHAMBER FOR ABRASIVE POWDER DESCALING THE SURFACE OF A STRIP

[76] Inventors: Jury V. Lipukhin, Cherepovets, ploschad Metallurgov, 5, kv. I5.; Leonid I. Danilov, Cherepovets, ulitsa Vereschagina, 5I, kv. 8.; Anatoly N. Subbotin, Cherepovets, prospekt Pobedy, I20, kv. I4.; Eduard A. Garber, Cherepovets, ulitsa M. Gorkogo, 85, kv. I7.; Viktor I. Abramenko, Cherepovets, prospekt Pobedy, 79, kv. 37., all of Vologodskaya oblast, U.S.S.R.

[21] Appl. No.: 294,487

[22] PCT Filed: Feb. 17, 1988

[86] PCT No.: PCT/SU88/00037

§ 371 Date: Oct. 14, 1988

§ 102(e) Date: Oct. 14, 1988

[87] PCT Pub. No.: WO88/06065

PCT Pub. Date: Aug. 25, 1988

[30] Foreign Application Priority Data

Feb. 18, 1987 [SU] U.S.S.R. ..... 4192538

[51] Int. Cl.[5] ..... B21B 45/06

[52] U.S. Cl. ..... 51/17; 51/7

[58] Field of Search ..... 51/7, 17, 18, 20, 317, 51/318, 156, Dig. 10, 328

[56] References Cited

U.S. PATENT DOCUMENTS

| | | | |
|---|---|---|---|
| 1,411,220 | 3/1922 | Meyers | 70/105 |
| 2,419,448 | 4/1947 | Gordon | 51/18 |

FOREIGN PATENT DOCUMENTS

| | | | |
|---|---|---|---|
| 0422494 | 9/1974 | U.S.S.R. | 51/7 |
| 0516515 | 7/1977 | U.S.S.R. | 51/17 |
| 1030056 | 7/1983 | U.S.S.R. . | |
| 2173722 | 10/1986 | United Kingdom . | |
| 2202474 | 9/1988 | United Kingdom . | |

OTHER PUBLICATIONS

PCT/SU 86/00074
PCT/SU 84/00029
PCT 04/1988

*Primary Examiner*—Robert Rose
*Attorney, Agent, or Firm*—Lilling & Greenspan

[57] ABSTRACT

The proposed chamber relates to sheet rolling in metallurgy. The chamber has two halves with a structure for closing, sealing, and opening the halves, and departing one half from the abutment plane, and includes two mechanisms for compacting the abrasive powder. The structure for closing, sealing, and opening the two halves along the abutment plane includes a ring having two cams divided by a slot. The ring sits in annular recesses separated by a slot and arranged on a support of the shaft of the mechanism for compacting the abrasive powder.

2 Claims, 3 Drawing Sheets

CHAMBER FOR ABRASIVE POWDER DESCALING THE SURFACE OF A STRIP

BACKGROUND OF THE INVENTION

1. Field of the Invention

This invention relates to metallurgy, and more particularly to a chamber for abrasive powder descaling of the surface of a strip.

2. Description of the Prior Art

There is known a chamber for abrasive powder descaling of the surface of a strip as described in International Application PCT/SU 84/00029.

This chamber comprises two mechanisms for compacting the abrasive powder, each such mechanism having two shafts with supports and levers connected to hydraulic power cylinders acting to turn the shafts, whereas blades secured on the shafts act to force the abrasive powder to the surface being cleaned thereby removing scale from the strip.

Access to parts and units inside the chamber (such as mechanisms for compacting the powder and others) necessitates prolonged stops, complete disassembly of the chamber, and reassembly. This in turn makes the chamber less efficient in operation and requires much labor to be consumed. It is therefore a disadvantage of such a chamber since it lacks the facility of drawing the chamber apart for facilitating access to its interior.

There is also known a chamber for abrasive powder descaling of the surface of a strip (cf., International Application PCT/SU 86/00074) made up of two halves with means for closing, sealing and drawing the halves apart along the plane of abutment, and departing one of the halves from the plane of abutment. This chamber, the closest prior art chamber, also comprises two mechanisms for compacting the abrasive powder, each having two shafts secured in supports in different halves of the chamber and linked with hydraulic power cylinders for turning the shafts.

As one half of the chamber is departed from the plane of abutment, the shafts with supports of the mechanisms for compacting the powder are departed therewith.

This feature is a substantial advantage over the prior art chamber (cf., PCT/SU 84/00029), as servicing and repair are considerably faciliated, by not necessitating complete disassembly of the chamber, and thereby reducing downtime.

However, this prototype chamber (PCT/SU 86/00074) is characterized by means for closing, sealing, and drawing the halves apart along the abutment plane which are not sufficiently quick-acting, but are fashioned, for example, as bolt and nut connections requiring much time for handling, whereby the advantage of two halves is not fully utilized.

SUMMARY OF THE INVENTION

It is an object of the present invention to provide a chamber for abrasive powder descaling of the surface of a strip having such quick-acting means for closing, sealing, and drawing the chamber halves apart along the abutment plane as to reduce the material and labor consumption associated with fabrication and servicing of the chamber, and to reduce the downtime.

The object is attained by a chamber for abrasive powder descaling the surface of a strip comprising two halves with means for closing these halves, sealing, drawing the halves apart along an abutment plane between these halves, and departing at least one half from the plane of abutment. The chamber includes at least two mechanisms for compacting the abrasive powder, each mechanism two shafts secured in supports in different halves of the chamber with levers connected to hydraulic power cylinders for turning the shafts. According to the invention, each means for closing, sealing, and drawing the halves apart along the abutment plane comprises a ring secured on the support of one of the shafts of the mechanism for compacting the abrasive powder and being capable of turning relative to the support by said hydraulic power cylinder. The ring has two cams separated by a slot and arranged at the side of the support of the other shaft of the same mechanism for compacting the abrasive powder. The support is provided with two annular recesses divided by a slot to receive the cams. The lever of the shaft, whose support is used for accomodating the ring has a pusher capable of movement from its own drive to the slot between the cams.

Provision in this construction of the means for closing, sealing, and drawing the halves apart along the abutment plane of the ring, arrangement of the ring on the support of one of the shafts of the mechanism for compacting the abrasive powder for the ring to be capable of turning from the hydraulic power cylinder intended to turn the shaft relative to the support, provision on this ring of two cams separated by a slot and arranged at the side of the support of the other shaft of the same mechanism for compacting the abrasive powder, arrangement at the support of the other shaft of two annular recesses separated by a slot to receive said cams, arrangement of a pusher on the lever of the shaft whose support is used for accomodating the ring, and the capacity of the pusher to move from its own drive to the slot between the cams-solve the problem of ensuring fast action of the means for closing, sealing and drawing the halves of the chamber apart along the abutment plate.

Actually, since two shafts of one mechanism for compacting the abrasive powder are disposed in different halves of the chamber, with the support of one such shaft accomodating the ring with cams and that of the other shaft having recessess receiving the cams, then during turning of the ring causing registration of its cams with the annular recesses the two halves of the chamber are closed very fast (without the use of bolt and nut connection). As the ring is turned in the opposite direction, the halves of the chamber are also brought apart promptly, since the cams leave the annular recesses with one such cam entering the slot between the recesses and the other cam resting over the support. In this manner, due to the provision of slots between the cams and between the recess, the cams do not hamper drawing the chamber halves apart.

When the pusher secured on the lever of the shaft is caused by its own drive to enter the slot between the cams of the ring, the lever is mechanically connected to the ring, and subsequent to actuation of the hydraulic power cylinder for turning the shaft the lever turns together with the shaft relative to its support to act through the pusher on the cams of the ring making it rotate relative to the same support. Therefore, closing and drawing apart the chamber halves takes place due to the action of the same cylinders that are intended to rotate the shafts of the mechanism for compacting the abrasive powder, whereby no special drive is required for closing, sealing, and bringing the chamber halves apart.

Subsequent to closing the halves of the chamber it is possible to displace the pusher back by its own drive causing its movement from the slot between the cams. The lever is no longer connected to the ring, and the hydraulic power cylinder for turning the shafts can be used directly for compacting the abrasive powder. In response to turning of the lever the ring no longer rotates and its cams rest in the annular recesses to retain the chamber halves drawn together.

Preferably, for increasing the sealing reliability of the chamber halves along the abutment plane, the opposite cylindrical surfaces of the annular recesses of the support of the second shaft define therebetween a wedge-shaped clearance.

As a result of the formation of the wedge-shaped clearance, the cams of the ring enter, the recesses with a tight fit providing a compressive stress along the plane of abutment between the two halves of the chamber.

The compressive stress guarantees complete closing of the joint between the chamber during operation.

BRIEF DESSCRIPITION OF THE DRAWINGS

The invention will now be described in greater detail with reference to a specific embodiment thereof taken in conjunction with the accompanying drawings, in which.

DESCRIPTION OF THE PREFERRED EMBODIMENT

Figure 1:
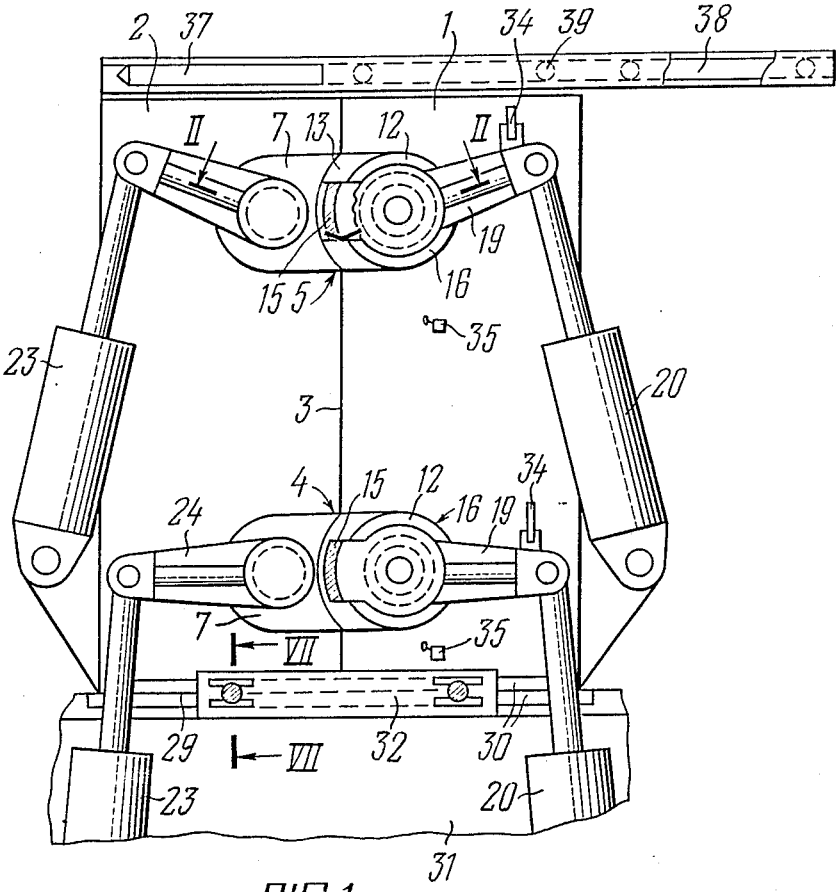
FIG. 1 is a general view of a chamber for abrasive powder cleaning of the surface of a strip from scale according to the invention.

The proposed chamber comprises a movable half 1 (FIG. 1) and a fixed half 2 mating along an abutment plane 3.

Figure 2:
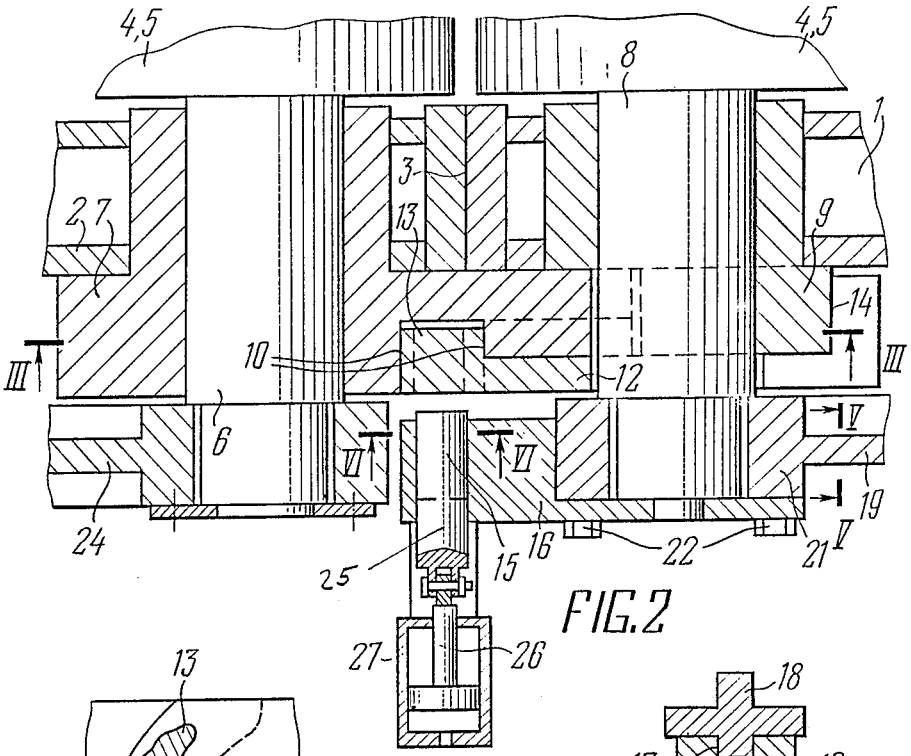
FIG. 2 is a section taken along the line II—II in FIG. 1.
Figure 3:
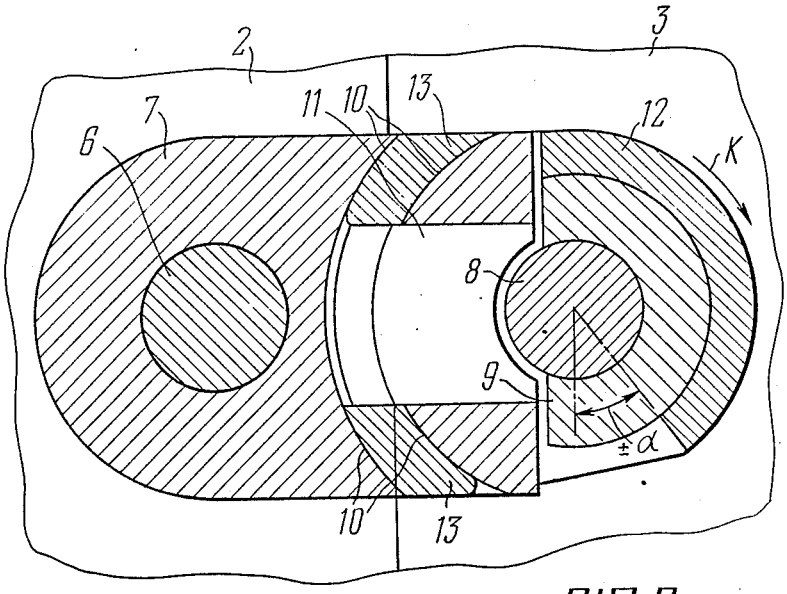
FIG. 3 is a section taken along the line III—III in FIG. 2.
Figure 4:
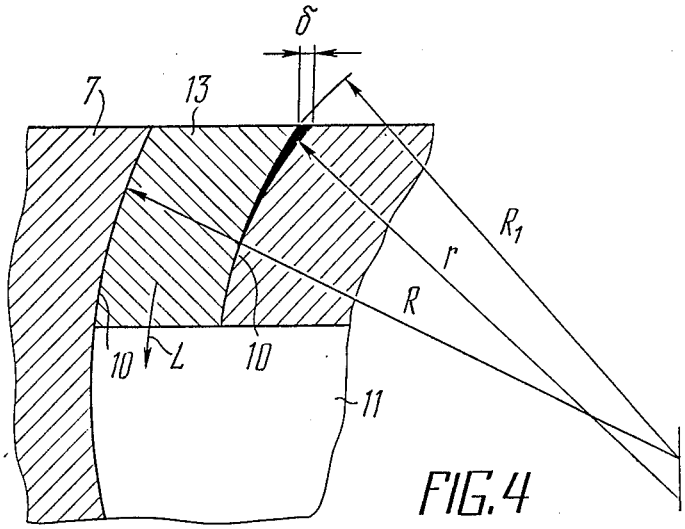
FIG. 4 is a schematic showing the formation of a tight fit between cams and annular recesses.

The chamber includes two mechanisms 4 and 5 for compacting abrasive powder, each having a shaft 6 (FIG. 2) journalled in supports 7 arranged in the fixed half 2, and a shaft 8 arranged in supports 9 secured in the movable half 1. Provided at the ends of the supports 7 of the shaft 6 are annular recesses 10 separated by a slot 11 (FIGS. 3, 4). Rings 12 (FIGS. 2, 3) having cams 13 are placed on the supports 9 of the shaft 8. Shoulders of the rings 12 are accomodated in annular grooves 14 (FIG. 2) of the supports 9 to be capable of reversible movement of the rings 12 with cams 13 to an angle $\pm+$ (FIG. 3) about a circular path. When the cams 13 of the rings 12 assume positions in the annular recesses 10 of the supports 7, the halves 1 and 2 of the chamber are closed and sealed along the abutment plane 3, and thereof the movable half 1 fails to depart from the fixed half 2, since the cams 13 with rings 12 are secured on the support 9 resting in the movable half 1, whereas the support 7 accomodating the cams 13 in annular recesses 10 rests in the fixed half 2. In the supports 7 the slots 11 dividing the annular recesses 10 of the support 7 of the shaft 6 are open toward the shafts 8.

Each of the rings 12 has therefore two cams 13, viz., upper and lower cams, of which the upper cam enters the annular recess 10 over the slot 11, whereas the lower cam enters the annular recess under the slot 11. As the lower cams 13 of the rings 12 enter the slots 11 of the supports 7 of the halves 1 and 2, the halves 1 and 2 of the chamber are detached, because the slot 11 allows a free movement of the lower cam 13 relative to the support 7 during departure of the movable half 1 of the chamber. The upper cam 13 rests above the support 7 to be capable of free movement relative to this support.

The direction of turning of the ring 12 to an angle $+\alpha$ for closing the halves 1 and 2 of the chamber is indicated by the arrow "L" in FIG. 4, whereas the direction of turning of the ring 12 to an angle $-\alpha$ for detaching the halves is shown by the arrow "K" (FIG. 3).

In the course of cleaning the strip from scale the mechanisms 4 (FIG. 2) and 5 for compacting the powder are acted upon by substantial spread forces arising due to the resistance of the scale to breaking, whereby these forces are transmitted to the halves 1 and 2 of the chamber tending to bring them apart. Therefore, the cams 13 should preferably be force-fitted into the annular recesses 10 rather than fitted freely, so as not to form a clearance under the working load in the abutment plane 3 between the halves 1 and 2 through which the power could fall out. To ensure such force-fitting, the outer cylindrical surface of the annular recess 10 having a radius R (FIG. 4) is not concentrical with its inner cylindrical surface having a radius $R_1$ for these surfaces to define therebetween a wedge-shaped clearance. The surfaces of the cams 13 corresponding to the surfaces of the annular recess 10 are mutually concentrical and have a radius of the outer surface equal to R, and that of the inner surface equal to r.

In this manner registration of the cams 13 with the recesses 10 provides force-fitting action of a magnitude "δ".

Figure 5:
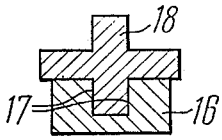
FIG. 5 is a section taken along the line V—V in FIG. 2.

In order to ensure turning of the ring 12 to an angle $\pm\alpha$ with a force necessary for providing force-fitting action of a magnitude "δ" between the cams 13 and annular recesses 10 of each support 7 without the use of a special drive, each mechanism 4, 5 has a pusher 15 (FIG. 2) a housing 16 (FIG. 5), of which has its recesses 17 affixed on a rib portion 18 of a lever 19 (FIG. 1) of a power cylinder 20 for turning the shaft 8, and is secured on a hub 21 (FIG. 2) of this lever by bolts 22. A similar power cylinder 23 (FIG. 1) with a lever 24 serves to turn the shaft 6 in the fixed half 2 of the chamber.

Figure 6:
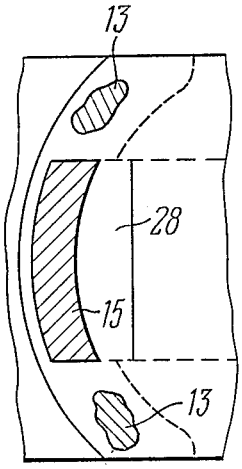
FIG. 6 is a section taken along the line VI—VI in FIG. 2.

The pusher 15 (FIG. 6) is capable of moving along an axis 25 (FIG. 2) to a contact with the cams 13 of the ring 12. A rod 26 of a pneumatic cylinder 27 serves to move the pusher 15. The ring 12 between the cams 13 has a slot 28 (FIG. 6) receiving the pusher 15, when it is in registration with the slot 11 of the support 7. Turning of the lever 19 is accompanied by turning of the housing 16 of the pusher 15, and therefore by turning of the pusher 15, which turns the ring 12 acting on the cams 13 and pushes them with a force-fitting action "δ" to the annular recesses 10.

Figure 7:
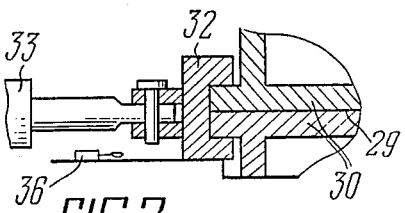
FIG. 7 is a section taken along the line VII—VII in FIG. 1.

Locking elements of a horizontal joint 29 (FIG.7) of the chamber have the form of projections 30 at the bottom part of the chamber and its base 31, and U-shaped plates 32 capable of movement, as well as engagement with or disengagement from the projections 30 by an actuating mechanism 33, such as a hydraulic power cylinder.

In order to limit the movement of the levers 19, there are provided stops 34 (FIG. 1) secured at the movable half 1 of the chamber. Limit switches 35 and 36 (FIG. 7) are further provided to indicate the position of the movable parts. Departure of the movable half 1 of the chamber is executed by hydraulic power cylinders 37 (FIG. 1) and guide beams 38 attached to the fixed half 2, the movable half 1 being provided with rollers 39.

The chamber operates in the following manner.

For bringing the closed halves 1 (FIG. 1) and 2 apart, a working pressure of oil is fed to the lower cavities of the hydraulic power cylinders 20 acting to turn the levers 19 upwards to a contact with the stops 34. Movement of the levers 19 (FIG. 2) is accompanied by counterclockwise turning of the housings 16 of the pushers 15 with pnuematic cylinders 27. Therewith, the pushers 15 are retracted into the housing 16 resulting in the absence of contact between the pusher 15 and ring 12, whereby the ring 12 remains stationary, whereas its cams 13 remain engaged with the support 7 entering with a force-fitting action "δ" into its annular recesses 10.

After the levers 19 stop in the extreme top position the pnuematic cylinders 27 are actuated for the rods 26 to force the pushers 15 forward along the axis 25 to the slots 28 (FIG. 6) of the rings 12 until they are brought into the contact with the cams 13. This movement ensures rigid connection of the levers 19 with the rings 12 (pushers 15 and their housing 16).

Then a pressure of oil is applied to the upper cavities of the hydraulic power cylinders 20 whereby the levers 19, moving downwards clockwise, act through the pushers 15 on the rings 12 with a force sufficient for overcoming the forces of compression and friction between the cams 13 and annular recesses 10—the delta of supports 7, connected with a force-fitting action "δ". The pushers 15 act to turn the rings 12 as shown by the arrow "K" (FIG. 3) to an angle "$-\alpha$" whereby the cams 13 leave the recesses 10, the upper cam 13 of each ring 12 resting over the support 7, whereas the lower cam 13 is received into the slot 11 between the annular recesses 10. After this the pusher 15 is drawn by the rod 26 of the pnuematic cylinder 27 into the housing 16, and the levers 19 are caused to be disengaged with the rings 12. The hydraulic power cylinders 20 stop as soon as the levers 19 are brought in contact with the limit switches 35.

For disengagement of the chamber with the base 31 (FIG. 1) along the horizontal joint 29 the actuating mechanisms 33 (FIG. 7) act to bring the U-shaped plates 32 out of engagement with the projection 30. As a result, the movable and stationary halves of the chamber are detached from each other and from the base 31. The hydraulic power cylinders 37 (FIG. 1) act on rollers 39 connected to the movable half 1 of the chamber for the rollers 39 to roll on the fixed guide beam 38 bringing the half 1 apart from the half 2 to a preset distance depending on the stroke of the rods of the hydraulic power cylinders 37. After operations associated with repairs and servicing, the halves 1 and 2 are brought together and locked in the reverse order; the hydraulic power cylinders 37 are reversed, rollers 39 move on guides 38 to bring the movable half 1 to a contact with the fixed half 2, the actuating mechanism 33 acts to move the U-shaped plate 32 to a contact with projections 30, the pnuematic cylinders 27 are actuated to move the pushers 15 along the axis 25 to the annular recesses 10 of the supports 7, the pushers 15 thereby entering the slots 28 of the rings 12 between the cams 13. Then the hydraulic power cylinders 20 of the mechanisms 4, 5 for compacting the powder are actuated to move the levers 19 counterclockwise, the levers 19 excerting action through the pushers 15 on the lower cams 13 of the rings 12, whereby the cams 13 are fitted with a force "δ" into the annular recesses 10 of the supports 7. This causes the halves 1 and 2 to be drawn together with a certain effort providing a prestressed state along the abutment plane 3. After this the pnuematic cylinders 27 act to move the pushers 15 backwards bringing them out of engagement with the rings 12, the halves 1 and 2 of the chamber are closed, and during further displacement of the levers 19 by the hydraulic power cylinders 20 these levers exert no action on the rings 12. The chamber is thus prepares for operations associated with removing scale from the strip.

In the course of cleaning the strip of scale the upper hydraulic power cylinders 20 and 23 act alternately with the lower hydraulic power cylinders 20 and 23 on the corresponding mechanisms 4 and 5 for compacting the abrasive powder providing efforts necessary for breaking the scale at the surface of the strip passing through the chamber in an upward direction (the strip is not shown in the FIGS.).

Thanks to preliminary compression of the abutment 3 between the halves 1 and 2 of the chamber produced by the force-fitting action "δ" between the cams 13 and annular recesses 10 of the supports 7 the thrust forces arising during abrasive powder cleaning and acting on the halves 1 and 2 of the chamber fail to open the joint therebetween.

An advantage of the proposed chamber, as compared with the prototype, resides in a substantial saving in the capital outlays for fabricating the chamber. Fast closing and opening of the chamber does not require the use of special hydraulic cylinders capable of developing a force equal to the force of the hydraulic power cylinders of the mechanism for compacting the powder, since the thrust force equals the working force of pressure of the powder on the strip.

The invention can be used with success in sheet rolling.

We claim:

1. A chamber for abrasive powder descaling of the surface of a strip comprising two halves of said chamber with means for closing said halves, sealing, drawing the halves apart along a plane of abutment along which the two halves mate, and departing of at least one half from the abutment plane, the chamber including at least two mechanisms for compacting the abrasive powder, each having two shafts secured in supports in different halves of the chamber with levers connected to hydraulic power cylinders for turning the shafts, CHARACTERIZED in that each means for closing, sealing and drawing the two halves of the chamber apart along the abutment plane comprises a ring secured on the support of one of the shafts of the mechanism for compacting the abrasive powder capable of turning by said hydraulic power cylinder relative to the support and having two cams separated by a slot and arranged at a side of the support of the other shaft of the same mechanism for compacting the abrasive powder, said support provided with two annular recesses divided by a slot to receive the cams, the lever of the shaft whose support is used for accomodating the ring having a pusher capable of movement by a drive to the slot between the cams.

2. A chamber as claimed in claim 1, CHARACTERIZED in that the opposite cylindrical surfaces of the annular recesses define therebetween a wedge-shaped clearance.

* * * * *